United States Patent [19]

Michlovic

[11] Patent Number: 4,813,195

[45] Date of Patent: Mar. 21, 1989

[54] SOLID CAVITY CORNER FOR LOCKSTRIP GASKETS

[75] Inventor: John J. Michlovic, Avon Lake, Ohio

[73] Assignee: The Standard Products Company, Cleveland, Ohio

[21] Appl. No.: 106,122

[22] Filed: Oct. 7, 1987

[51] Int. Cl.[4] ..... E06B 2/62

[52] U.S. Cl. ..... 52/400; 52/208; 52/656

[58] Field of Search ..... 52/208, 211, 213, 216, 52/397–400, 484, 656, 403, 631

[56] References Cited

U.S. PATENT DOCUMENTS

| | | | |
|---|---|---|---|
| 2,956,705 | 10/1960 | Clingman . | |
| 3,009,216 | 11/1961 | Kimber . | |
| 3,079,651 | 3/1963 | Hagmann et al. . | |
| 3,230,677 | 1/1966 | Brown | 52/208 |
| 3,279,124 | 10/1966 | Brown . | |
| 3,381,435 | 5/1968 | Smith . | |
| 3,416,279 | 12/1968 | Dallen . | |
| 3,445,965 | 5/1969 | Paulus . | |

FOREIGN PATENT DOCUMENTS

| | | | |
|---|---|---|---|
| 680898 | 2/1964 | Canada | 52/400 |
| 889069 | 12/1971 | Canada | 52/400 |
| 1901136 | 8/1970 | Fed. Rep. of Germany | 52/400 |

*Primary Examiner*—David A. Scherbel
*Assistant Examiner*—Richard E. Chilcot, Jr.
*Attorney, Agent, or Firm*—Harness, Dickey & Pierce

[57] ABSTRACT

A gasket having an integral formed corner is disclosed. The corner includes a resilient member having a first and second portion. The first and second portions have free depending ends which are secured to gasket strips to form a peripheral gasket. The other end of the first and second portions are joined together such that the portions are angled with respect to one another. Also, the first and second portions each have a first face and a pair of glass securing wings which project from each of the first and second portions. A channel to receive glass is formed between each pair of the wings. A first and second cavity to receive locking strips are formed in the first face of the first and second portion, respectively. A plug is formed at the junction of the first and second portions such that the plug separates the first cavity from the second cavity to enable locking strips to abut against the plug. The plug exerts force to enhance the seal of the glass in the channel.

10 Claims, 2 Drawing Sheets

FIG. 1.
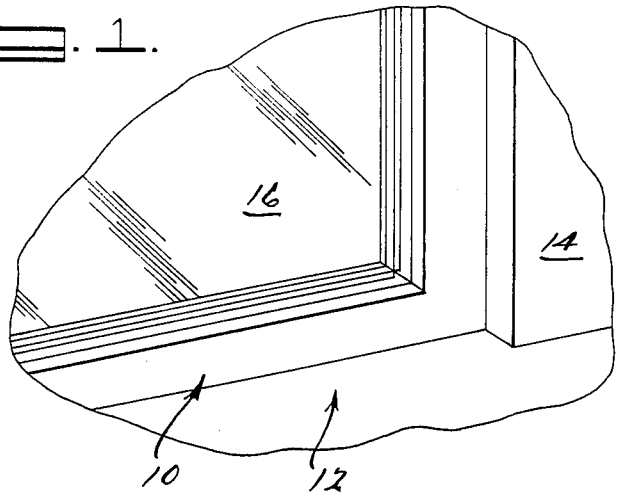
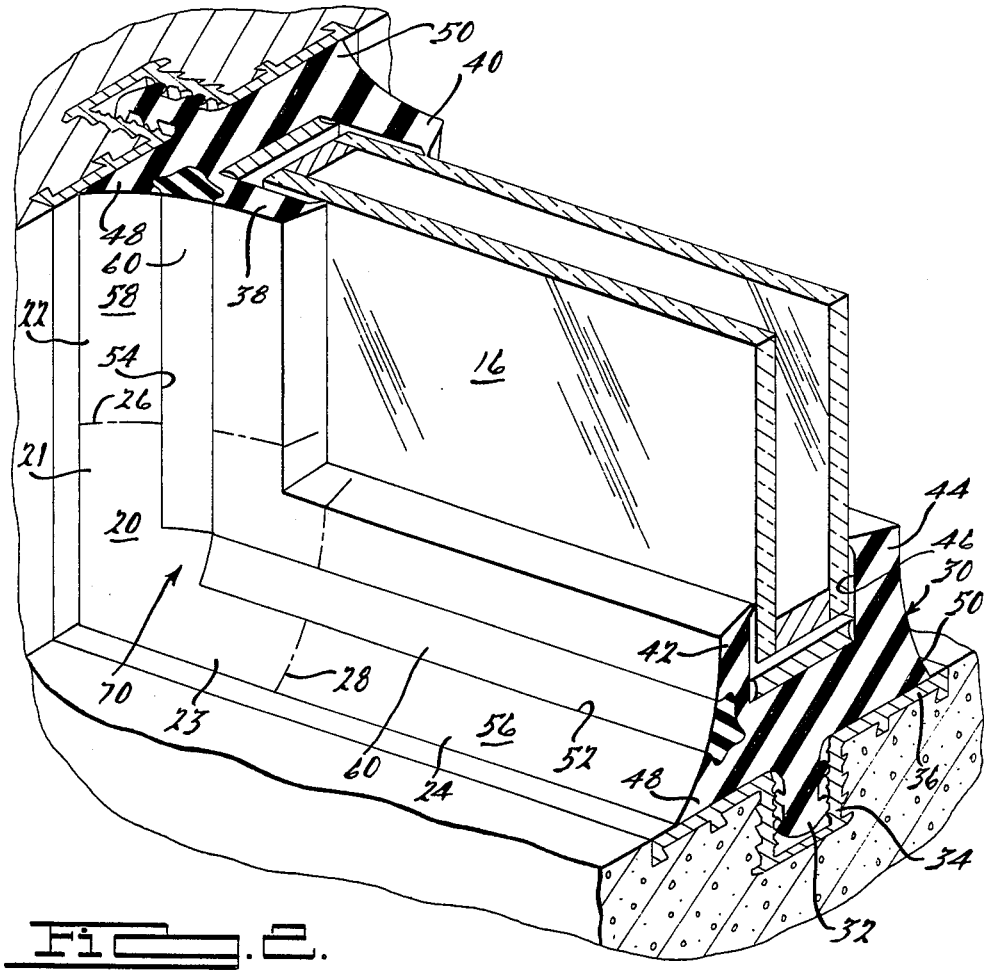
FIG. 2.

SOLID CAVITY CORNER FOR LOCKSTRIP GASKETS

BACKGROUND AND SUMMARY OF THE INVENTION

The present invention relates to resilient gaskets. More particularly, the invention relates to lockstrip type glazing gaskets having injection molded corners or intersections.

Lockstrip glazing gaskets, formed from elastomeric materials such as neoprene, are widely used for mounting, sealing and cushioning panels, such as sheet glass, in the walls of buildings. Generally, when forming peripheral glazing gaskets, straight lengths of gasket material are extruded and cut to a predetermined length. Two or more of the straight lengths of gasket material are then placed into a mold and an intersection is formed to couple the straight lengths of glazing gasket material together by molding additional rubber between the straight lengths. Typically T's, L's and cross (+) intersections are produced by this process.

It would be desirable to have intersections, particularly L corners, such as 90° corners, which provide increased pressure against the sheet glass or panel to enhance sealing. Several types of intersections are known in the art. For example, various intersections or corners are illustrated in the following U.S. Pat. Nos. 2,956,705; 3,009,216; 3,079,651; 3,279,124; 3,381,435; 3,416,279; and 3,445,965. Conventional lockstrip glazing gaskets provide a discontinuous pressure against the glazed glass or panel at intersections of straight lengths because the wedging action of the lockstrip is discontinuous at the intersections. This type of locking action is illustrated in U.S. Pat. Nos. 3,445,965; 3,279,124 and 3,461,279. Conventional lockstrip gaskets may also require additional reinforcement material, such as steel, to provide additional strength in the gasket corners as seen in U.S. Pat. No. 2,956,705. Other conventional lockstrip corners provide continuous locking strip cavities to enhance the ease of positioning the glass sheets into the channel. While the reinforcement material strengthens the corners, it hinders the positioning of the glass panels into the channel. Also while the continuous locking strip cavity about the corner enables ease of glazing it does not provide optimum sealing forces to seal rubber against glass directed from the corner; and the corner is the most likely location of leaking.

The present invention provides an improvement over the above mentioned lockstrip gaskets. Thus, the present invention provides a new and improved gasket corner having a discontinuous locking strip cavity and a plug at the junction of the locking strip cavities. The plug in the locking strip cavity is symmetrical about the corner. An abutment face is formed at each edge of the plug to provide a starting or stopping point for a subsequently applied locking strip. The plug increases the pressure of the gasket wings against the glass to seal the glass in the gasket. The plug assures maximum glass sealing pressures at the corner to seal the glass within the gasket. The plug enables the subsequently installed locking strip to have a more accurate, and therefore aesthetically appealing, starting or stopping point.

From the reading of the detailed description of the preferred embodiment, which makes reference to the accompanying drawings, additional objects and advantages of the present invention will become apparent to those skilled in the art.

BRIEF DESCRIPTION OF THE DRAWINGS

FIG. 1 is a perspective view, broken away, showing a preferred embodiment of a glazing gasket of the present invention in association with a window.

FIG. 2 is an enlarged perspective view, broken away, of an injection molded corner portion of the glazing gasket of FIG. 1.

DETAILED DESCRIPTION OF THE PREFERRED EMBODIMENT

Figure 3:
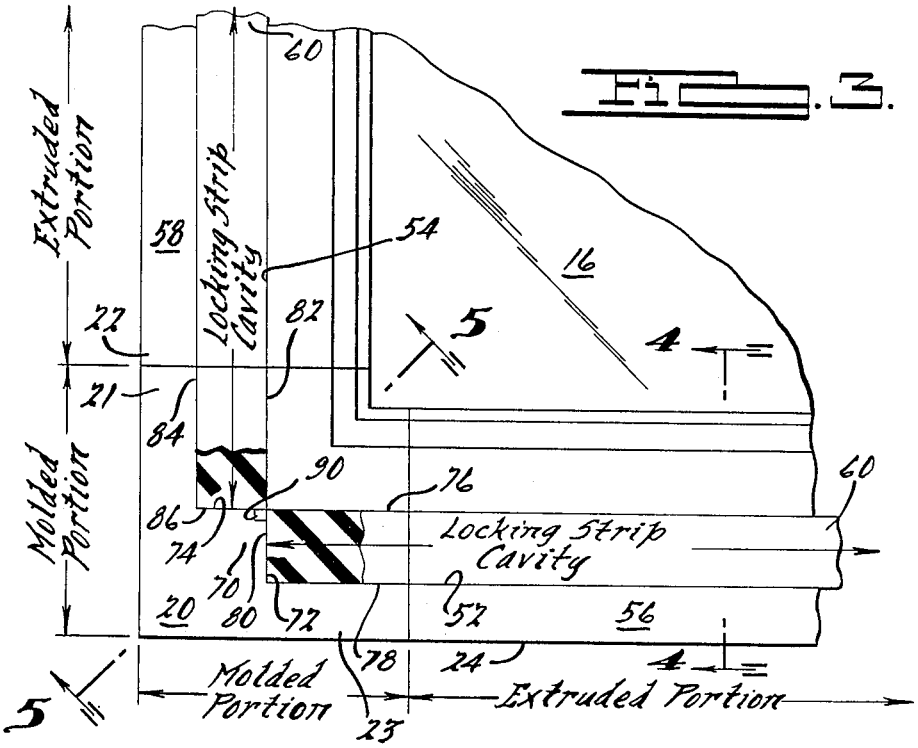
FIG. 3 is an elevational view of the corner gasket of FIG. 1.

Turning to FIG. 1, a preferred embodiment of a resilient gasket of this invention is illustrated and designated with the reference numeral 10. Gasket 10 is illustrated positioned in a window opening 12 of a building 14. Gasket 10 has sheet glass or panel 16 positioned within the gasket.

Turning to FIG. 2, a corner of gasket 10 is illustrated and designated with the reference numeral 20. Corner 20 is injection molded to connect first 21 and second 23 portions with straight length strips 22 and 24 of gasket 10 along lines 26 and 28. The strips 22 and 24 and corner portions 21 and 23 include a base 30 that may have many configurations depending upon the attachment or mounting configuration of the gasket 10 within the window frame opening 12. The configuration shown in FIG. 2 anticipates mounting or attaching from the underside of the gasket strips by forcing the rubber spline 32 into channel 34 of a receiver 36. Receiver 36 is generally cast into window opening 12 prior to the attachment of gasket 10. Several other types of receivers may be utilized and the described receiver 36 is not meant to limit the present invention.

Base 30 of gasket 10 has wings 38, 40, 42, and 44, on respective strips 22 and 24 and portions 21 and 23, which define a continuous glazing channel 46. The base 30 includes sealing members 48 and 50 to seal the gasket 10 against the opening 12 of building 14. The portions 21 and 23 and strips 22 and 24 include cavities 52 and 54 on their faces 56 and 58 to receive locking strips 60 which secure the glass or panel 16 within the channel 46.

Gasket 10 can comprise, for example, four lengths of gasket strips 22 and 24 and four corners 20 forming a rectangular gasket. However, fewer and/or additional corners and strips may be utilized to provide varying curved and/or polygonal shaped gaskets. Ordinarily, the strips 22 and 24 are placed into a mold and virgin rubber is added to form corner 20 with portions 21 and 23 connected to strips 22 and 24 by a molding process to form an integral gasket as seen in FIGS. 1 and 2.

Figure 4:
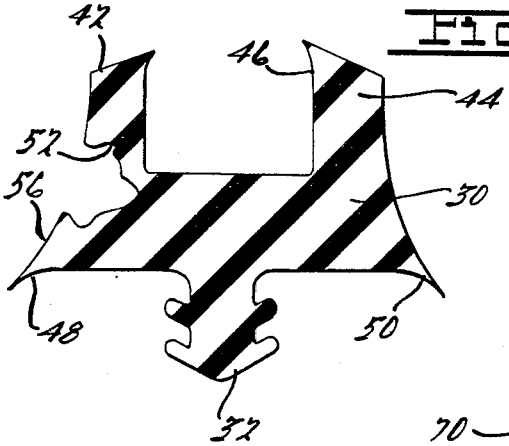
FIG. 4 is a cross-sectional view taken along line 4—4 of FIG. 3.

Turning to FIG. 4, the corner 20 includes an integrally formed plug 70 at the termination of cavities 52 and 54. The plug 70 has a first 72 and second 74 abutment face at the terminus of cavities 52 and 54, respectively. The abutment faces 72 and 74 are generally perpendicular to one another when a 90° corner is desired.

The cavity 52 formed in the first portion face 56 is defined by a first edge 76, a second edge 78 which is substantially parallel to the first edge 76 and a third edge 80 which is substantially perpendicular to both the first and second edges 76 and 78 and is integral with the plug abutment face 72 as seen in FIG. 3. Likewise, cavity 54 is defined on face 58 by a first edge 82, a second edge 84 which is substantially parallel to first edge 82, and a third edge 86 which is perpendicular to both edges 82 and 84 and is integral with plug abutment face 74 as seen in FIG. 3. The cavities 52 and 54 terminate at the plug abutment faces 72 and 74 such that the cavities first edges 76 and 82, respectively, intersect to define a substantially right angle corner 90 of the plug 70, when a 90° corner is desired. It should be noted that corners may be formed of any desired angle. The plug 70 provides increased pressure against the glass or panel 16 at the corner 20 to further enhance the sealing of the glass or panel in the channel 46. Also, the plug 70 enables a laborer installing the locking strip 60 in the cavities, to have a flat planar surface to abut against with the locking strip 60. The plug 70 with planar abutment faces 72 and 74 provide the gasket 10 with an appealing aesthetic appearance when the locking strip 60 is abutted against the plug abutment faces 72 and 74.

Referring to FIGS. 2 and 3, locking strip cavities 52 and 54 are discontinuous at the corner 20, where plug 70 is included to stiffen the corner. Unlike conventional corners where locking strip cavities are continuous around the corner, the subject invention provides maximum sealing pressure between the glass or panel 16 and sealing wings 38 and 40 and 42 and 44 in the installed condition.

Figure 5:
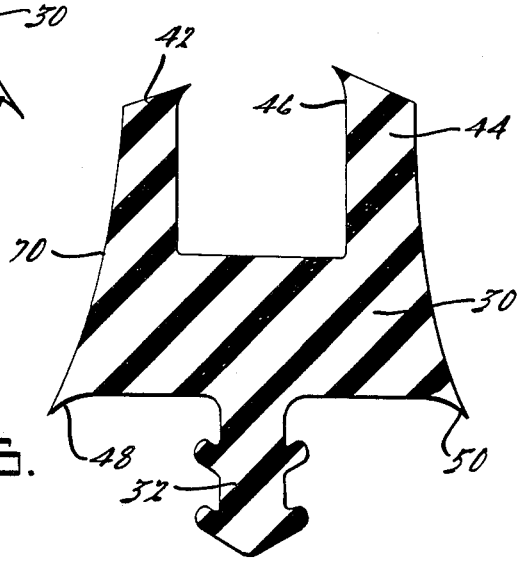
FIG. 5 is a cross-sectional view taken along line 5—5 of FIG. 3.

FIG. 5 illustrates a cross-section view through the plug 70 of corner 20 to illustrate the discontinuity of the locking strip cavities 52 and 54. Note that the glass channel 46 is substantially deeper in the corner than along the strip 24 as seen in FIG. 4. The added depth reduces the net pressures applied by locking strips 60 in this area. The solid plug 70 provides the additional sealing pressure required to maintain a water and air seal at the corners 20.

In addition, the present invention provides the locking strips 60 with continuous wedging action between edges 76 and 78 and between edges 82 and 84. Conventional locking strips without the corner plug 70 of the present invention have discontinuous wedging action at the corner and are therefore more subject to unwanted removal of the locking strips by vandals.

While the above summarizes the present invention, it will become apparent to one skilled in the art that modifications, variations and alterations may be made to the present invention without deviating from the scope and fair meaning of the subjoined claims.

What is claimed is:

1. A resilient gasket corner for lockstrip type gaskets comprising:

a resilient member having a first portion and a second portion, said first and second portions having a free depending end and being joined together at their other ends such that said portions are angled with respect to one another and forming an integral corner, said first and second portions each having a first face;

a pair of wings for securing glass or panels within the corner projecting from each said first and second portions;

a continuous channel for receiving glass or panels formed between each said pair of wings;

a first cavity for receiving a locking strip formed in said first face of said first portion of said member and a second cavity for receiving a locking strip formed in said first face of said second portion of said member; and plug means formed in said member at the junction of said first and second cavities such that said plug means separates said first cavity from said second cavity to enable locking strips to abut said plug means, said plug means being continuous with said first faces and solid so that said first and second cavities are discontinuous at said plug means, said plug means exerting force for securing and sealing glass or panels in said channel.

2. The gasket corner according to claim 1 wherein said free depending ends of said first and second portions of said base are adhered to extruded gasket strips.

3. The gasket corner according to claim 1 further comprising anchor means coupled with said member for securing said corner in an opening.

4. The gasket corner according to claim 1 wherein said first and second cavities each having a perimeter defined on each said first face, each cavity defined by a first, second and third edge, said first and second edges being substantially parallel to one another and said third edge substantially perpendicular to the other two edges, said third edges being defined by said plug means.

5. The gasket corner according to claim 4 wherein said third edge of said first cavity is substantially colinear with said first edge of said second cavity and said third edge of said second cavity is substantially colinear with said first edge of said first cavity.

6. The gasket corner according to claim 1 wherein said plug means includes a first face at the terminus of said first cavity and a second face at the terminus of said second cavity.

7. A lockstrip resilient window gasket including at least one corner comprising:

a gasket strip member with a first face, anchor means coupled with said member for securing said gasket strip in an opening, a pair of wings for securing glass projecting from said member and coupled with said member to define a channel between said wings for insertion of glass into said channel, and a cavity on said member first face for enabling insertion of a locking strip for forcing the wings against glass or panels in said channel, said gasket strip member having two ends;

a second member having a first portion and a second portion, said first and second portions having two ends, one end of said first portion secured to one end of said gasket strip member and one end of said second portion secured to the other end of said gasket strip member, the other ends of said first and second portions molded together such that said first and second portions are angled with respect to one another, said first and second portions having a first face;

an anchor means coupled with said first and second portions for securing said first and second portions in an opening, said anchor means is continuous with said gasket strip anchor means;

a pair of wings for securing glass or panels projecting from each said first and second portions, said wings are continuous with said gasket strip wings;

a continuous channel for receiving glass or panels formed between each said pair of wings, said channel is continuous with said gasket strip channel;

a first cavity for receiving a locking strip formed in said first face of said first portion and a second cavity for receiving a locking strip formed in said first face of said second portion, said first and second cavities are continuous with said gasket strip cavity; and plug means formed at the junction of said first and second cavities such that said plug means separates said first cavity from said second cavity to enable locking strips to abut said plug means, said plug means being solid and stationary so that said first and second cavities terminate at said plug means, said plug means exerting force on said glass or panels for securing glass or panels in said channel and for enhancing sealing of said glass or panels at said junction.

8. The gasket according to claim 7 wherein said first and second cavities have a perimeter defined on said first face, each cavity defined by a first, second and third edge, said first and second edges being substantially perpendicular to the third edges, said third edges being defined by said plug means.

9. The gasket according to claim 8 wherein said third edge of said first cavity is substantially colinear with said first edge of said second cavity and said third edge of said second cavity is substantially colinear with said first edge of said first cavity.

10. The gasket according to claim 7 wherein said plug means includes a first face at the terminus of said first cavity and a second face at the terminus of said second cavity.

* * * * *